US010535305B2

(12) United States Patent
Wang et al.

(10) Patent No.: US 10,535,305 B2
(45) Date of Patent: Jan. 14, 2020

(54) AMOLED DISPLAY PANEL WITH FUNCTION OF TEMPERATURE COMPENSATION AND DISPLAY DEVICE THEREOF

(71) Applicant: SHENZHEN CHINA STAR OPTOELECTRONICS SEMICONDUCTOR DISPLAY TECHNOLOGY CO., LTD., Shenzhen (CN)

(72) Inventors: Zhenling Wang, Guangdong (CN); Tai-Jiun Hwang, Guangdong (CN)

(73) Assignee: SHENZHEN CHINA STAR OPTOELECTRONICS SEMICONDUCTOR DISPLAY TECHNOLOGY CO., LTD., Shenzhen Guangdong (CN)

( * ) Notice: Subject to any disclaimer, the term of this patent is extended or adjusted under 35 U.S.C. 154(b) by 83 days.

(21) Appl. No.: 15/576,770

(22) PCT Filed: Oct. 19, 2017

(86) PCT No.: PCT/CN2017/106880

§ 371 (c)(1),
(2) Date: Nov. 24, 2017

(87) PCT Pub. No.: WO2019/024256

PCT Pub. Date: Feb. 7, 2019

(65) Prior Publication Data

US 2019/0043424 A1 Feb. 7, 2019

(30) Foreign Application Priority Data

Aug. 2, 2017 (CN) ..... 2017 1 0650367

(51) Int. Cl.
*G09G 3/3241* (2016.01)

(52) U.S. Cl.
CPC ... *G09G 3/3241* (2013.01); *G09G 2300/0819* (2013.01); *G09G 2320/0271* (2013.01);
(Continued)

(58) Field of Classification Search
CPC ..... G09G 3/3241
(Continued)

(56) References Cited

U.S. PATENT DOCUMENTS

2013/0321361 A1 12/2013 Lynch
2014/0300281 A1* 10/2014 Chaji ..... G09G 3/3233 315/161
(Continued)

FOREIGN PATENT DOCUMENTS

CN 104350536 A 2/2015
CN 105190739 A 12/2015
(Continued)

*Primary Examiner* — Long D Pham
(74) *Attorney, Agent, or Firm* — Muncy, Geissler, Olds & Lowe, P.C.

(57) ABSTRACT

An AMOLED display panel includes data lines, scanning lines, a plurality of pixel units surrounded by the data lines and the scanning lines, a plurality of first driving circuits correspondingly arranged in pixel units arranged on predetermined positions, a plurality of second driving circuits arranged in the pixel units on another positions, and a temperature adjustment circuit. An input terminal of the temperature adjustment circuit is connected to the first pixel driving circuits, and an output terminal of the temperature adjustment circuit is connected to the data lines.

10 Claims, 3 Drawing Sheets

(52) U.S. Cl.
CPC ..... *G09G 2320/041* (2013.01); *G09G 2320/0673* (2013.01)

(58) Field of Classification Search
USPC ..... 345/690
See application file for complete search history.

(56) References Cited

U.S. PATENT DOCUMENTS

| | | | | |
|---|---|---|---|---|
| 2015/0042630 | A1* | 2/2015 | Lee | G09G 3/3233 345/211 |
| 2017/0076670 | A1* | 3/2017 | Chaji | G09G 3/3233 |
| 2017/0148385 | A1 | 5/2017 | Kishi | |
| 2018/0261162 | A1 | 9/2018 | Jaffari et al. | |

FOREIGN PATENT DOCUMENTS

| | | | |
|---|---|---|---|
| CN | 105913802 | A | 8/2016 |
| CN | 105913803 | A | 8/2016 |
| CN | 105957473 | A | 9/2016 |

* cited by examiner

AMOLED DISPLAY PANEL WITH FUNCTION OF TEMPERATURE COMPENSATION AND DISPLAY DEVICE THEREOF

BACKGROUND

1. Field of the Disclosure

The present disclosure relates to the field of a display technique, and more particularly, to an active-matrix organic light-emitting diode (AMOLED) display panel with a function of temperature compensation and a display device with the AMOLED display panel.

2. Description of the Related Art

Please refer to FIG. 1 illustrating a schematic diagram of a pixel driving circuit of an active-matrix organic light-emitting diode (AMOLED) display panel of the related art. The pixel driving circuit includes a first thin-film transistor (TFT) T11, a second thin-film transistor (TFT) T12, a third thin-film transistor (TFT) T13, a storage capacitor C11, and an organic light-emitting diode (OLED) D11.

A scanning signal SCAN is received by a gate of the first T11. A data signal DATA is received by a source of the first T11. A drain of the first T11 is electrically connected to a first node P. A gate of the second T12 is electrically connected to the first node P. A source of the second T12 is electrically connected to a driving voltage Ovdd. A drain of the second T12 is electrically connected to a second node Q. A sensing pulse signal Sen is received by a gate of the third T13. A sensing controlling signal Mon is received by a source of the third T13. A drain of the third T13 is electrically connected to the second node Q. One terminal of the storage capacitor C11 is electrically connected to the first node P. The other terminal of the storage capacitor C11 is electrically connected to the second node Q. An anode of an OLED D10 is electrically connected to the second node Q. A cathode of the OLED D10 is electrically connected to a driving voltage Ovss. The sensing controlling signal Mon is configured to sense the OLED D11 and the threshold voltage of the OLED D11 for driving the second TFT T12 to compensate for the data signal based on the sense threshold voltage, thereby stabilizing the brightness of the OLED D11 constantly.

However, when the AMOLED display panel of the related art is used long time, the temperature of the AMOLED display panel may rise too high. Once the temperature of the AMOLED display panel is too high, the threshold voltage of the second TFT T12 may offset, thereby resulting in an increase in the current of the OLED D11 and further shortening the lifespan of the OLED D11 in the AMOLED display panel.

Therefore, it is necessary to provide an AMOLED display panel with a function of temperature compensation and a display device with the AMOLED display panel to solve the problem of the related art.

SUMMARY

An object of the present disclosure is to propose an active-matrix organic light-emitting diode (AMOLED) display panel with a function of temperature compensation and a display device with the AMOLED display panel to solve the problem of the related art that the lifespan of the AMOLED display panel and the lifespan of an organic light-emitting diode (OLED) arranged in the display device is shorter.

According to one aspect of the present disclosure, an active-matrix organic light-emitting diode (AMOLED) display panel includes data lines, scanning lines, a plurality of pixel units surrounded by the data lines and the scanning lines, a plurality of first driving circuits that are correspondingly arranged in pixel units arranged on predetermined positions, a plurality of second driving circuits that are arranged in the pixel units on another positions, a temperature adjustment circuit configured to regulate a temperature of the AMOLED display panel. An input terminal of the temperature adjustment circuit is connected to the first pixel driving circuits to receive temperature sensing signals of the pixel units arranged on predetermined positions, and an output terminal of the temperature adjustment circuit is connected to the data lines to adjust data signals according to the temperature sensing signals. Each first pixel driving circuit comprises a first thin-film transistor (TFT) comprising a gate connected to one of the scanning lines and a source connected to one of the data lines, a second TFT comprising a gate connected to a drain of the first TFT and a source connected to a driving voltage source, a third TFT comprising a gate connected to a sensing controlling signal line, a source connected to a corresponding sensing signal line, and a drain connected to a drain of the second TFT, a storage capacitor connected between the gate of the second TFT and the drain of the third TFT, a fourth TFT that comprises a gate connected to the temperature adjustment circuit, a source connected to the drain of the third TFT, and the first OLED comprising a positive electrode connected to a drain of the fourth TFT and a negative electrode grounded. Each second pixel driving circuit comprises a fourth thin-film transistor (TFT) comprising a gate connected to one of the scanning lines and a source connected to one of the data lines, a fifth TFT comprising a gate connected to a drain of the fourth TFT and a source connected to a driving voltage source, a sixth TFT that comprises a gate connected to a sensing controlling signal line, a source connected to a sensing signal line, and a drain connected to a drain of the fifth TFT, a second storage capacitor connected between the gate of the fifth TFT and the drain of the sixth TFT, and a second organic light-emitting diode (OLED) comprising a positive electrode connected to the drain of the sixth TFT and a negative electrode grounded.

According to another aspect of the present disclosure, an active-matrix organic light-emitting diode (AMOLED) display panel includes data lines, scanning lines, a plurality of pixel units surrounded by the data lines and the scanning lines, a plurality of first driving circuits that are correspondingly arranged in pixel units arranged on predetermined positions, a plurality of second driving circuits that are arranged in the pixel units on another positions, a temperature adjustment circuit configured to regulate a temperature of the AMOLED display panel. An input terminal of the temperature adjustment circuit is connected to the first pixel driving circuits to receive temperature sensing signals of the pixel units arranged on predetermined positions, and an output terminal of the temperature adjustment circuit is connected to the data lines to adjust data signals according to the temperature sensing signals.

According to the present disclosure, each first pixel driving circuit comprises a first thin-film transistor (TFT) comprising a gate connected to one of the scanning lines and a source connected to one of the data lines, a second TFT comprising a gate connected to a drain of the first TFT and a source connected to a driving voltage source, a third TFT comprising a gate connected to a sensing controlling signal line, a source connected to a corresponding sensing signal line, and a drain connected to a drain of the second TFT, a storage capacitor connected between the gate of the second TFT and the drain of the third TFT, a fourth TFT that comprises a gate connected to the temperature adjustment circuit, a source connected to the drain of the third TFT, and the first OLED comprising a positive electrode connected to a drain of the fourth TFT and a negative electrode grounded.

According to the present disclosure, each second pixel driving circuit comprises a first thin-film transistor (TFT) comprising a gate connected to one of the scanning lines and a source connected to one of the data lines, a second TFT comprising a gate connected to a drain of the first TFT and a source connected to a driving voltage source, a third TFT, comprising a gate connected to a sensing controlling signal line, a source connected to a corresponding sensing signal line, and a drain connected to a drain of the second TFT, a storage capacitor connected between the gate of the second TFT and the drain of the third TFT, and an organic light-emitting diode (OLED) comprising a positive electrode connected to the drain of the third TFT and a negative electrode grounded.

According to the present disclosure, the predetermined positions refers to a central area of the AMOLED display panel or temperature sampling positions of the AMOLED display panel.

According to the present disclosure, a time period of showing a frame by each of the pixel units arranged on the predetermined positions in the AMOLED display panel comprises a pixel driving stage, a driving maintaining stage, and a temperature sensing stage which are performed subsequently.

According to the present disclosure, when each of the pixel units arranged on the predetermined positions is operated in the pixel driving stage, the first TFT, the second TFT, the third TFT, and the fourth TFT all are turned on, a data signal is fed through the data line, and a data compensating signal is outputted by the sensing signal line. When each of the pixel unit arranged on the predetermined positions is operated in the driving maintaining stage, the first TFT, the second TFT, and the third TFT all are turned off and the fourth TFT is turned on to maintain a luminous intensity of the OLED through the storage capacitor.

According to the present disclosure, when each of the pixel units arranged on the predetermined positions is operated in the temperature sensing stage, the first TFT, the second TFT, and the third TFT all are turned on and the fourth TFT is turned off, the OLED stops emitting light, a predetermined grayscale signal is input through the corresponding data line, and the temperature sensing signal is output through the sensing signal line.

According to the present disclosure, the temperature adjustment circuit is configured to obtain the temperature sensing signals from the pixel units arranged on the predetermined positions, and to calculate sensing currents flowing through the second TFTs of the pixel units arranged on the predetermined positions according to the temperature sensing signal. The temperature adjustment circuit is configured to calculate an average value of the sensing currents of the pixel units on the predetermined positions. The temperature adjustment circuit is configured to adjust the data signal according to the average value and a predetermined threshold current so that an average value of adjusted sensing current is less than and equal to the predetermined threshold current.

According to the present disclosure, the temperature adjustment circuit is configured to adjust a grayscale value of the data signal or a Gamma value of the data signal.

According to still another aspect of the present disclosure, an active-matrix organic light-emitting diode (AMOLED) display device having an AMOLED display panel is provided. The active-matrix organic light-emitting diode (AMOLED) display panel includes data lines, scanning lines, a plurality of pixel units surrounded by the data lines and the scanning lines, a plurality of first driving circuits that are correspondingly arranged in pixel units arranged on predetermined positions, a plurality of second driving circuits that are arranged in the pixel units on another positions, a temperature adjustment circuit configured to regulate a temperature of the AMOLED display panel. An input terminal of the temperature adjustment circuit is connected to the first pixel driving circuits to receive temperature sensing signals of the pixel units arranged on predetermined positions, and an output terminal of the temperature adjustment circuit is connected to the data lines to adjust data signals according to the temperature sensing signals.

According to the present disclosure, each first pixel driving circuit comprises a first thin-film transistor (TFT) comprising a gate connected to one of the scanning lines and a source connected to one of the data lines, a second TFT comprising a gate connected to a drain of the first TFT and a source connected to a driving voltage source, a third TFT comprising a gate connected to a sensing controlling signal line, a source connected to a corresponding sensing signal line, and a drain connected to a drain of the second TFT, a storage capacitor connected between the gate of the second TFT and the drain of the third TFT, a fourth TFT that comprises a gate connected to the temperature adjustment circuit, a source connected to the drain of the third TFT, and the first OLED comprising a positive electrode connected to a drain of the fourth TFT and a negative electrode grounded.

According to the present disclosure, each second pixel driving circuit comprises a first thin-film transistor (TFT) comprising a gate connected to one of the scanning lines and a source connected to one of the data lines, a second TFT comprising a gate connected to a drain of the first TFT and a source connected to a driving voltage source, a third TFT, comprising a gate connected to a sensing controlling signal line, a source connected to a corresponding sensing signal line, and a drain connected to a drain of the second TFT, a storage capacitor connected between the gate of the second TFT and the drain of the third TFT, and an organic light-emitting diode (OLED) comprising a positive electrode connected to the drain of the third TFT and a negative electrode grounded.

According to the present disclosure, the predetermined positions refers to a central area of the AMOLED display panel or temperature sampling positions of the AMOLED display panel.

According to the present disclosure, a time period of showing a frame by each of the pixel units arranged on the predetermined positions in the AMOLED display panel comprises a pixel driving stage, a driving maintaining stage, and a temperature sensing stage which are performed subsequently.

According to the present disclosure, when each of the pixel units arranged on the predetermined positions is operated in the pixel driving stage, the first TFT, the second TFT, the third TFT, and the fourth TFT all are turned on, a data signal is fed through the data line, and a data compensating signal is outputted by the sensing signal line. When each of the pixel unit arranged on the predetermined positions is operated in the driving maintaining stage, the first TFT, the second TFT, and the third TFT all are turned off and the fourth TFT is turned on to maintain a luminous intensity of the OLED through the storage capacitor.

According to the present disclosure, when each of the pixel units arranged on the predetermined positions is operated in the temperature sensing stage, the first TFT, the second TFT, and the third TFT all are turned on and the fourth TFT is turned off, the OLED stops emitting light, a predetermined grayscale signal is input through the corresponding data line, and the temperature sensing signal is output through the sensing signal line.

According to the present disclosure, the temperature adjustment circuit is configured to obtain the temperature sensing signals from the pixel units arranged on the predetermined positions, and to calculate sensing currents flowing through the second TFTs of the pixel units arranged on the predetermined positions according to the temperature sensing signal. The temperature adjustment circuit is configured to calculate an average value of the sensing currents of the pixel units on the predetermined positions. The temperature adjustment circuit is configured to adjust the data signal according to the average value and a predetermined threshold current so that an average value of adjusted sensing current is less than and equal to the predetermined threshold current.

According to the present disclosure, the temperature adjustment circuit is configured to adjust a grayscale value of the data signal or a Gamma value of the data signal.

In the present disclosure, a first pixel driving circuit with a function of temperature sensing is arranged in the AMOLED display panel with the function of temperature compensation and the display device with the AMOLED display panel. Moreover, the structure of the first pixel driving circuit is simple. In this way, the temperature of the AMOLED display panel can be sensed and adjusted in real time, which effectively solving the problem that the lifespan of the AMOLED display panel and the OLED arranged in the display device is shorter.

BRIEF DESCRIPTION OF THE DRAWINGS

The invention is described below in detail with reference to the accompanying drawings, wherein like reference numerals are used to identify like elements illustrated in one or more of the figures thereof, and in which exemplary embodiments of the invention are shown.

DETAILED DESCRIPTION OF THE EMBODIMENTS

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

Figure 1:
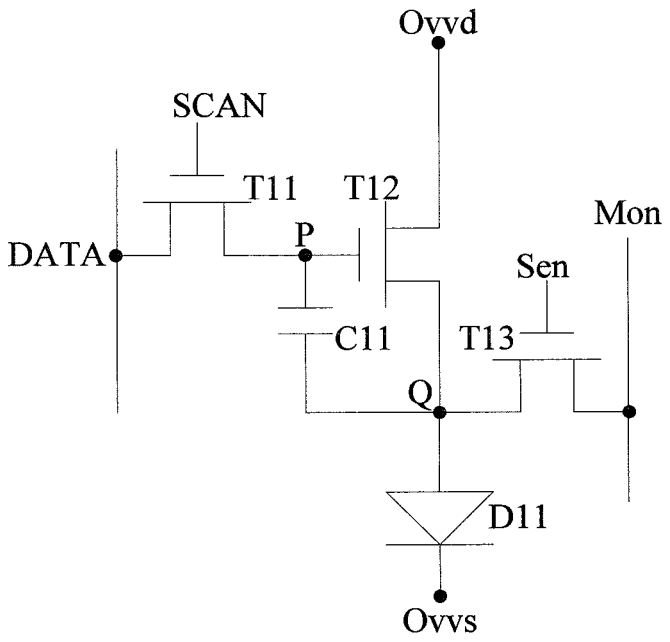
Fig. 1 (Related art)
FIG. 1 is a schematic diagram of a conventional active-matrix organic light-emitting diode (AMOLED) display panel.
Figure 2:
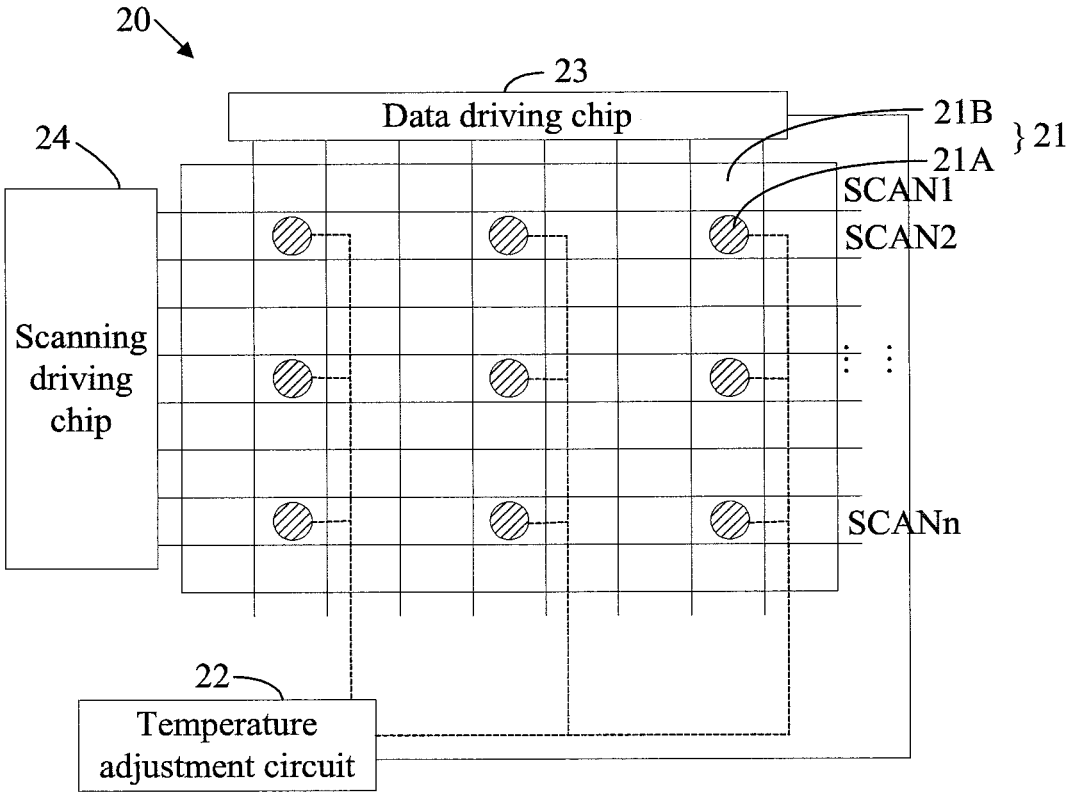
FIG. 2 is a schematic diagram of an active-matrix organic light-emitting diode (AMOLED) display panel with a function of temperature compensation according to an embodiment of the present disclosure.

FIG. 2 is a schematic diagram of the structure of an active-matrix organic light-emitting diode (AMOLED) display panel 20 with a function of temperature compensation according to an embodiment of the present disclosure. The AMOLED display panel 20 includes a data line, scanning lines (such as SCAN1, SCAN2, and SCANn), a plurality of pixel units 21 interwoven by the data line and the scanning lines, and a temperature adjustment circuit 22 with the function of temperature compensation configured to adjust the temperature of the AMOLED display panel 20.

A data signal in the data line is generated by a data driving chip 23. A scanning signal in the scanning line is generated by a scanning driving chip 24.

The pixel unit 21 illustrated in FIG. 2 is divided into two kinds of units. One is a pixel unit 21A and the other is a pixel unit 21B. The pixel unit 21A is arranged on a predetermined position and has functions of driving pixels and sensing temperature. The pixel unit 21B is arranged on another position and only has a function of driving pixels. A first driving circuit 30 is arranged in the pixel unit 21A on the predetermined position and configured to display and drive the pixel unit 21A. A second driving circuit 40 is arranged in the pixel unit 21B on the other position and configured to display and drive the pixel unit 21B.

In another embodiment, a predetermined position here may be a central position of an active-matrix organic light-emitting diode (AMOLED) display panel 20 or a temperature sampling position of the AMOLED display panel 20, as what is shown by a pixel unit 21A illustrated in FIG. 2. Further, the temperature sampling position can be determined according to a user's request.

An input terminal of the temperature adjustment circuit 22 is connected to the first pixel driving circuit 30 to receive a temperature sensing signal which the pixel unit 21A corresponds to. An output terminal of the temperature adjustment circuit 22 is connected to the data line through the data driving chip 23 to adjust the data signal according to the temperature sensing signal.

Figure 3:
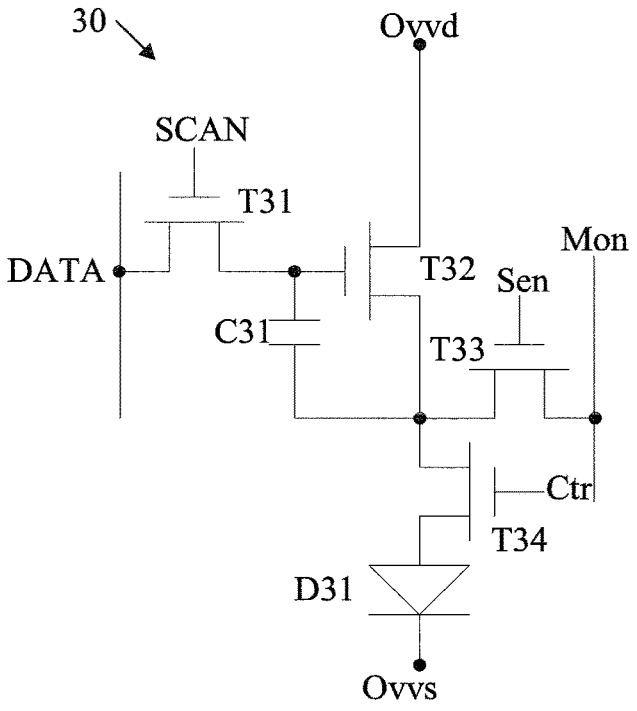
FIG. 3 illustrates a circuit diagram of a first pixel driving circuit of the AMOLED display panel shown in FIG. 2 according to an embodiment of the present disclosure.

FIG. 3 is a circuit diagram of the first pixel driving circuit 30 which the pixel unit 21A arranged on the predetermined position in FIG. 2 corresponds to. FIG. 3 is a schematic diagram of the structure of the first pixel driving circuit 30 of the AMOLED display panel with the function of temperature compensation according to the embodiment of the present disclosure. The first pixel driving circuit 30 includes a first thin-film transistor (TFT) T31, a second TFT T32, a third TFT T33, a storage capacitor C31, a fourth TFT T34, and an organic light-emitting diode (OLED) D31.

A gate of the first TFT T31 is connected to the corresponding scanning line SCAN. A source of the first TFT T31 is connected to the corresponding data line DATA. A drain of the first TFT T31 is connected to a gate of the second TFT T32. A source of the second TFT T32 is connected to a driving voltage source Ovvd. A drain of the second TFT T32 is connected to a drain of the third TFT T33. A source of the third TFT T33 is connected to a corresponding sensing signal line Mon. A gate of the third TFT T33 is connected to a sensing controlling signal line Sen. One terminal of the storage capacitor C31 is connected to the gate of the second TFT T32. The other terminal of the storage capacitor C31 is connected to the drain of the third TFT T33. A gate of the fourth TFT T34 is connected to the temperature adjustment circuit 22. A source of the fourth TFT T34 is connected to the drain of the third TFT T33. A drain of the fourth TFT T34 is connected to a positive electrode of the OLED D31. A negative electrode of the OLED D31 is grounded (connected to a driving voltage source Ovvs).

Figure 4:
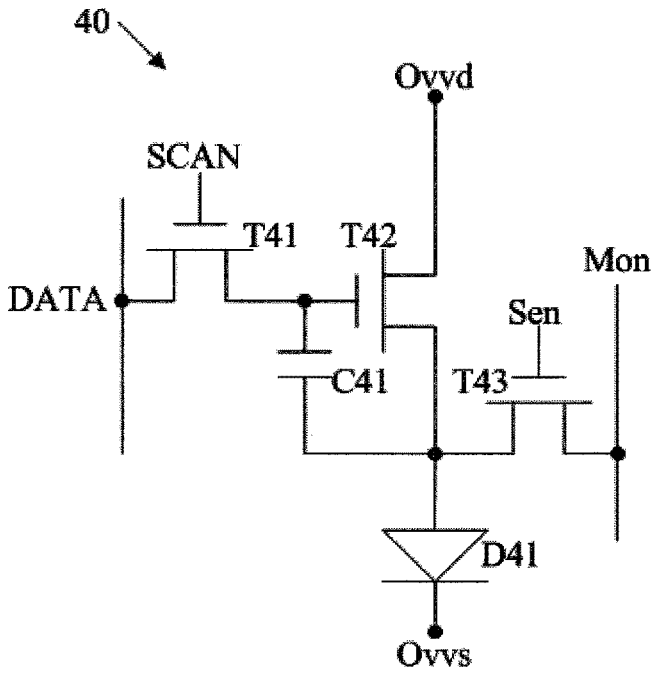
FIG. 4 illustrates a circuit diagram of a second pixel driving circuit of the AMOLED display panel shown in FIG. 2 according to an embodiment of the present disclosure.

The concrete circuit of the second pixel driving circuit which the pixel units on the other positions in FIG. 2 correspond to is illustrated in FIG. 4. FIG. 4 is a schematic diagram of the structure of a second pixel driving circuit 40 of an active-matrix organic light-emitting diode (AMOLED) display panel with a function of temperature compensation in another embodiment of the present disclosure. The second pixel driving circuit 40 includes a first thin-film transistor (TFT) T41, a second TFT T42, a third TFT T43, a storage capacitor C41, and an organic light-emitting diode (OLED) D41.

A gate of the first TFT T41 is connected to the corresponding scanning line SCAN. A source of the first TFT T41 is connected to the corresponding data line DATA. A drain of the first TFT T41 is connected to a gate of the second TFT T2. A source of the second TFT T42 is connected to a driving voltage source Ovvd. A drain of the second TFT T42 is connected to a drain of the third TFT T43. A source of the third TFT T43 is connected to the corresponding sensing signal line Mon. A gate of the third TFT T43 is connected to the sensing controlling signal line Sen. One terminal of the storage capacitor C41 is connected to the gate of the second TFT T42. The other terminal of the storage capacitor C41 is connected to the drain of the third TFT T43. A positive electrode of the OLED D41A is connected to the drain of the third TFT T43. A negative electrode of the OLED D41 is grounded (connected to the driving voltage source Ovvs).

Figure 5:
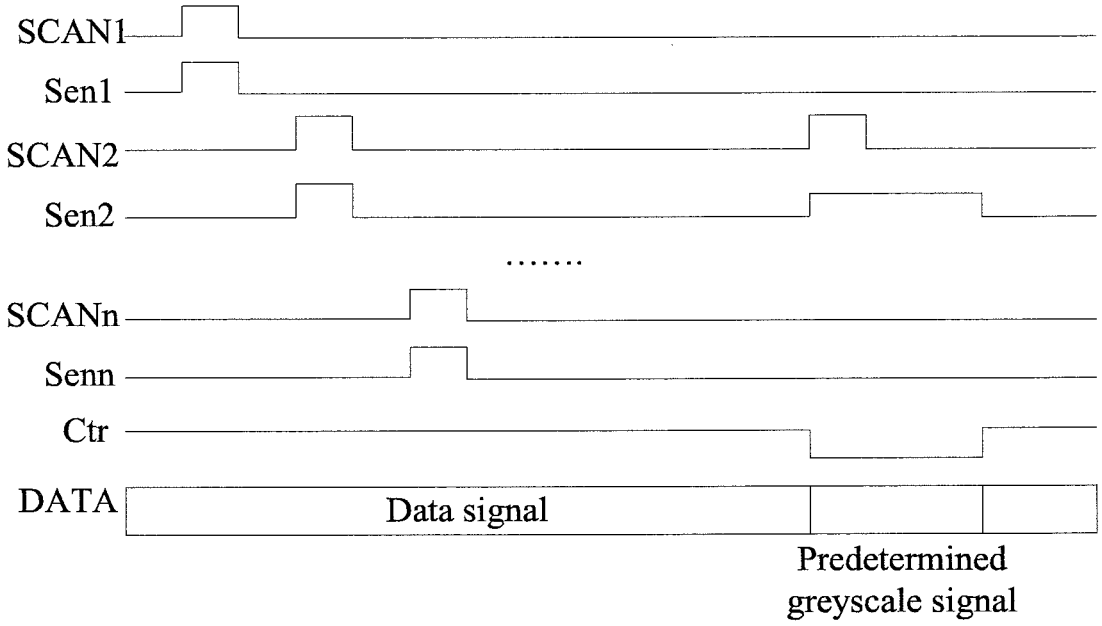
FIG. 5 illustrates waveforms applied on the AMOLED display panel shown in FIG. 2 according to an embodiment of the present disclosure.

The working principle of the AMOLED display panel with the function of temperature compensation is elaborated in FIG. 1 to FIG. 5 in the present disclosure. FIG. 5 is a driving waveform diagram of an active-matrix organic light-emitting diode (AMOLED) display panel with a function of temperature compensation in another embodiment of the present disclosure.

Each frame of the pixel unit (like the pixel unit 21A illustrated in FIG. 2) arranged on the predetermined position in the AMOLED display panel in the embodiment of the present disclosure includes a pixel driving stage, a driving maintaining stage, and a temperature sensing stage which are performed subsequently.

When the pixel unit 21A on the predetermined position keeps at the pixel driving stage, the first TFT T31, the second TFT T32, the third TFT T33, and the fourth TFT T34 all are turned on. Besides, a data signal is input through the corresponding data line DATA, and a data compensating signal is output through a sensing signal line Mon.

When the pixel unit 21A on the predetermined position keeps at the driving maintaining stage, the first TFT T31, the second TFT T32, and the third TFT T33 of the first pixel driving circuit 30 all are turned off and the fourth TFT T34 is turned on to maintain the luminous intensity of the OLED D31 through the storage capacitor C31.

When the pixel unit 21A on the predetermined position keeps at the temperature sensing stage, the first TFT T31, the second TFT T32, and the third TFT T33 of the first pixel driving circuit 30 all are turned on and the fourth TFT T34 is turned off. Besides, the OLED D31 stops emitting light, a predetermined grayscale signal is input through the corresponding data line DATA, and a temperature sensing signal is output through the sensing signal line Mon.

Each of the frames of the pixel unit 21B on another position on the AMOLED display panel includes a pixel driving stage and a driving maintaining stage which are performed subsequently in the embodiment of the present disclosure. The concrete working principle here is consistent with the above-mentioned pixel driving stage and driving maintaining stage of the pixel unit 21A on the predetermined position.

As FIG. 5 illustrates, the pixel unit 21A in a second row keeps at the pixel driving stage. Moreover, the first TFT T31, the second TFT T32, the third TFT T33, and the fourth TFT T34 all are turned on. A high-voltage-level scanning signal is input to the corresponding scanning line SCAN2. The data signal is input to the data line DATA. The OLED D31 illuminates normally. Accordingly, the pixel unit 21A displays normally. Meanwhile, a sensing controlling signal line Sen2 jumps to a high-voltage-level, and the data compensating signal is output through the corresponding sensing signal line Mon.

Afterwards, the pixel unit 21A keeps at the driving maintaining stage. The first TFT T31, the second TFT T32, and the third TFT T33 of the first pixel driving circuit 30 all are turned off, and the fourth TFT T34 is turned on. The luminous intensity of the OLED D31 is maintained through the storage capacitor C31. A low-voltage-level signal is input to the scanning line SCAN2 and the sensing controlling signal line Sen2 at this time.

When the whole frame finishes being scanned, that is, after the frame of the current image finishes being displayed and driven, the pixel unit 21A keeps at the temperature sensing stage. Besides, the first TFT T31, the second TFT T32, and the third TFT T33 all are turned on, the fourth TFT T34 is turned off, and the OLED D31 stops emitting light.

A low-voltage-level disconnection signal Ctr is input to the gate of the fourth TFT T34. A high-voltage-level signal is input through the scanning line SCAN2 and the sensing controlling signal line Sen2. The predetermined grayscale signal (such as a 128 grayscale signal) is input by the first TFT T31 and the second TFT T32 through the DATA, and afterwards, the temperature sensing signal is output by the third TFT T33 through the sensing signal line Mon.

To stabilize the dropout voltage on two terminals of the storage capacitor C31, the high-voltage-level duration of the scanning line SCAN2 should be less than the high-voltage-level duration of the sensing controlling signal line Sen2 while the image is normally displayed with the other pixel units.

The temperature adjustment circuit 22 may collect the temperature sensing signal which the pixel unit 21A on the predetermined position corresponds to through the sensing signal line Mon. The sensing signal line Mon is configured to collect the data compensating signal when being at the image display stage. Therefore, the temperature adjustment circuit 22 may be arranged in a data signal compensation chip of the related art to further lower the production cost of the AMOLED display panel.

Afterwards, the temperature adjustment unit 22 calculates a sensing current of the second TFT T32 which the temperature sensing signal corresponds to. Afterwards, the temperature adjustment unit 22 calculates the average value of sensing currents which all of the pixel units 21A on the predetermined positions correspond to.

Finally, the temperature adjustment circuit 22 adjusts the data signal through the data driving chip 23 according to the average value of the sensing currents and a predetermined threshold current so that the adjusted average value of the sensing currents is less than the predetermined threshold current to prevent the temperature of the temperature of the AMOLED display panel 20 from rising too high.

In another embodiment, a method of adjusting a data signal is to adjust a grayscale value of a data signal or a Gamma value of the data signal.

In this way, the temperature of the pixel unit on the predetermined position in the AMOLED display panel with the function of temperature compensation finishes collection and the temperature of the AMOLED display panel finishes compensation in the embodiment of the present disclosure.

Further, an active-matrix organic light-emitting diode (AMOLED) display device is proposed by the present disclosure. The AMOLED display device includes an AMOLED display panel with a function of temperature compensation as mentioned above. The working principle of the AMOLED display device proposed by the present disclosure is the same as or similar to the AMOLED display panel with the function of temperature compensation as mentioned above. The details of the AMOLED display panel with the function of temperature compensation have been discussed, which can be referred if needed.

In the present disclosure, a first pixel driving circuit with a function of temperature sensing is arranged in the AMOLED display panel with the function of temperature compensation and the display device with the AMOLED display panel. Moreover, the structure of the first pixel driving circuit is simple. In this way, the temperature of the AMOLED display panel can be sensed and adjusted in real time, which effectively solving the problem that the lifespan of the AMOLED display panel and the OLED arranged in the display device is shorter.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. An active-matrix organic light-emitting diode (AMOLED) display panel, comprising:

data lines;

scanning lines;

a plurality of pixel units surrounded by the data lines and the scanning lines;

a plurality of first driving circuits, correspondingly arranged in pixel units arranged on predetermined positions, each first pixel driving circuit comprising:

a first thin-film transistor (TFT), comprising a gate connected to one of the scanning lines and a source connected to one of the data lines;

a second TFT, comprising a gate connected to a drain of the first TFT and a source connected to a driving voltage source;

a third TFT, comprising a gate connected to a sensing controlling signal line, a source connected to a corresponding sensing signal line, and a drain connected to a drain of the second TFT;

a storage capacitor, connected between the gate of the second TFT and the drain of the third TFT;

a fourth TFT, comprising a gate connected to the temperature adjustment circuit, a source connected to the drain of the third TFT, and a drain connected to a positive electrode of an organic light-emitting diode (OLED); and the OLED, comprising a negative electrode grounded;

a plurality of second driving circuits, arranged in the pixel units on another positions;

a temperature adjustment circuit configured to regulate a temperature of the AMOLED display panel, wherein an input terminal of the temperature adjustment circuit is connected to the first pixel driving circuits to receive temperature sensing signals of the pixel units arranged on predetermined positions, and an output terminal of the temperature adjustment circuit is connected to the data lines to adjust data signals according to the temperature sensing signals, wherein a time period of showing a frame by each of the pixel units arranged on the predetermined positions in the AMOLED display panel comprises a pixel driving stage, a driving maintaining stage, and a temperature sensing stage which are performed subsequently, wherein when each of the pixel units arranged on the predetermined positions is operated in the pixel driving stage, the first TFT, the second TFT, the third TFT, and the fourth TFT all are turned on, a data signal is fed through the data line, and a data compensating signal is outputted by the sensing signal line;

when each of the pixel unit arranged on the predetermined positions is operated in the driving maintaining stage, the first TFT, the second TFT, and the third TFT all are turned off and the fourth TFT is turned on to maintain a luminous intensity of the OLED through the storage capacitor.

2. The AMOLED display panel of claim 1, wherein the predetermined positions refers to a central area of the AMOLED display panel or temperature sampling positions of the AMOLED display panel.

3. The AMOLED display panel of claim 1, wherein when each of the pixel units arranged on the predetermined positions is operated in the temperature sensing stage, the first TFT, the second TFT, and the third TFT all are turned on and the fourth TFT is turned off, the OLED stops emitting light, a predetermined grayscale signal is input through the corresponding data line, and the temperature sensing signal is output through the sensing signal line.

4. The AMOLED display panel of claim 3, wherein the temperature adjustment circuit is configured to obtain the temperature sensing signals from the pixel units arranged on the predetermined positions, and to calculate sensing currents flowing through the second TFTs of the pixel units arranged on the predetermined positions according to the temperature sensing signal;

the temperature adjustment circuit is configured to calculate an average value of the sensing currents of the pixel units on the predetermined positions; and the temperature adjustment circuit is configured to adjust the data signal according to the average value and a predetermined threshold current so that an average value of adjusted sensing current is less than and equal to the predetermined threshold current.

5. The AMOLED display panel of claim 4, wherein the temperature adjustment circuit is configured to adjust a grayscale value of the data signal or a Gamma value of the data signal.

6. An active-matrix organic light-emitting diode (AMOLED) display device, comprising an AMOLED display panel, the AMOLED display panel comprising:

data lines;

scanning lines;

a plurality of pixel units surrounded by the data lines and the scanning lines;

a plurality of first driving circuits, correspondingly arranged in pixel units arranged on predetermined positions, each first pixel driving circuit comprising:

a first thin-film transistor (TFT), comprising a gate connected to one of the scanning lines and a source connected to one of the data lines;

a second TFT, comprising a gate connected to a drain of the first TFT and a source connected to a driving voltage source;

a third TFT, comprising a gate connected to a sensing controlling signal line, a source connected to a corresponding sensing signal line, and a drain connected to a drain of the second TFT;

a storage capacitor, connected between the gate of the second TFT and the drain of the third TFT;

a fourth TFT, comprising a gate connected to the temperature adjustment circuit, a source connected to the drain of the third TFT, and a drain connected to a positive electrode of an organic light-emitting diode (OLED); and the OLED, comprising a negative electrode grounded;

a plurality of second driving circuits, arranged in the pixel units on another positions;

a temperature adjustment circuit configured to regulate a temperature of the AMOLED display panel, wherein an input terminal of the temperature adjustment circuit is connected to the first pixel driving circuits to receive temperature sensing signals of the pixel units arranged on predetermined positions, and an output terminal of the temperature adjustment circuit is connected to the data lines to adjust data signals according to the temperature sensing signals, wherein a time period of showing a frame by each of the pixel units arranged on the predetermined positions in the AMOLED display panel comprises a pixel driving stage, a driving maintaining stage, and a temperature sensing stage which are performed subsequently, wherein when each of the pixel units arranged on the predetermined positions is operated in the pixel driving stage, the first TFT, the second TFT, the third TFT, and the fourth TFT all are turned on, a data signal is fed through the data line, and a data compensating signal is outputted by the sensing signal line;

when each of the pixel unit arranged on the predetermined positions is operated in the driving maintaining stage, the first TFT, the second TFT, and the third TFT all are turned off and the fourth TFT is turned on to maintain a luminous intensity of the OLED through the storage capacitor.

7. The AMOLED display device of claim 6, wherein the predetermined positions refers to a central area of the AMOLED display panel or temperature sampling positions of the AMOLED display panel.

8. The AMOLED display device of claim 6, wherein when each of the pixel units arranged on the predetermined positions is operated in the temperature sensing stage, the first TFT, the second TFT, and the third TFT all are turned on and the fourth TFT is turned off, the OLED stops emitting light, a predetermined grayscale signal is input through the corresponding data line, and the temperature sensing signal is output through the sensing signal line.

9. The AMOLED display device of claim 8, wherein the temperature adjustment circuit is configured to obtain the temperature sensing signals from the pixel units arranged on the predetermined positions, and to calculate sensing currents flowing through the second TFTs of the pixel units arranged on the predetermined positions according to the temperature sensing signal;

the temperature adjustment circuit is configured to calculate an average value of the sensing currents of the pixel units on the predetermined positions; and the temperature adjustment circuit is configured to adjust the data signal according to the average value and a predetermined threshold current so that an average value of adjusted sensing current is less than and equal to the predetermined threshold current.

10. The AMOLED display device of claim 9, wherein the temperature adjustment circuit is configured to adjust a grayscale value of the data signal or a Gamma value of the data signal.

* * * * *